US007250006B2

(12) United States Patent
McGonigle

(10) Patent No.: US 7,250,006 B2
(45) Date of Patent: Jul. 31, 2007

(54) GOLF ACCESSORY

(76) Inventor: Peter McGonigle, 122A Lower Edge Road, Brighouse, HD6 3LD (GB)

( * ) Notice: Subject to any disclaimer, the term of this patent is extended or adjusted under 35 U.S.C. 154(b) by 0 days.

(21) Appl. No.: 11/079,365

(22) Filed: Mar. 14, 2005

(65) Prior Publication Data

US 2005/0202897 A1 Sep. 15, 2005

(30) Foreign Application Priority Data

Mar. 13, 2004 (GB) ..... 0405722.0
May 26, 2004 (GB) ..... 0411732.1

(51) Int. Cl.
*A63B 53/14* (2006.01)
*A63B 57/00* (2006.01)

(52) U.S. Cl. ..... 473/285

(58) Field of Classification Search ..... 473/285
See application file for complete search history.

(56) References Cited

U.S. PATENT DOCUMENTS

| | | | | | |
|---|---|---|---|---|---|
| 2,700,547 | A | | 1/1955 | Kraeling | 273/162 |
| 3,774,913 | A | * | 11/1973 | Dien | 473/285 |
| 4,955,609 | A | * | 9/1990 | Kassen | 473/286 |
| 5,087,044 | A | * | 2/1992 | Okushima | 473/285 |
| 5,282,616 | A | * | 2/1994 | Stacavich-Notaro | 473/406 |
| 5,377,977 | A | * | 1/1995 | MacNeary | 473/286 |
| 5,779,558 | A | * | 7/1998 | Britton | 473/286 |
| 6,102,263 | A | | 8/2000 | Rosato et al. | |

FOREIGN PATENT DOCUMENTS

JP 5-175 * 1/1993

* cited by examiner

*Primary Examiner*—Stephen Blau
(74) *Attorney, Agent, or Firm*—Head, Johnson & Kachigian

(57) ABSTRACT

An accessory for a golf club comprising a ball marker and a pitch repair portion, the ball marker selectively retained in a recess of the pitch repair portion such that a user can slide, pull or roll the ball marker from the recess. The accessory is suitable for locating in a golf club head or grip provided with an opening. The pitch repair portion includes legs which can be sprung or otherwise biased to grip the internal wall of the golf club when located therein.

6 Claims, 10 Drawing Sheets

GOLF ACCESSORY

CROSS-REFERENCE TO RELATED APPLICATION

This is a United States Patent application entitled "Golf Accessory" which claims priority to British Application No. 0405722.0 filed 13 Mar. 2004 and British Patent Application No. 0411732.1 filed 26 May 2004.

STATEMENT REGARDING FEDERALLY SPONSORED RESEARCH OR DEVELOPMENT (N/A)

INCORPORATION-BY-REFERENCE OF MATERIAL SUBMITTED ON A COMPACT DISC (N/A)

BACKGROUND OF THE INVENTION

The invention to which this application relates is a ball marker holder for attachment to a golf club which may be provided with one or more integrated accessory, such as a pitch (grounds, greens or field) repairer.

Although the following description refers almost exclusively to use of a pitch repairer and ball marker in the game of golf, it will be appreciated by persons skilled in the art that the present invention can be used on any type of land and is not exclusive to the game of golf.

Accessories for the game of golf are well known, such as tees for driving, putting aids, and trolley configurations.

Pitch repairers are often used to repair the indentation in the ground caused by a ball landing on the same. Typically they are presented in a fixed fork configuration, such that the fork is inserted into the ground near the damaged area and manoeuvred to lift the dent back into a substantially flat configuration. Such actions help to preserve to condition of the golf course in a state of good repair.

In the game of golf, it is usual for the player with the ball furthest from the hole to play until this is no longer the case. Occasionally, it is necessary to move another player's golf ball, if closer to the hole and in the line of play of the further ball, to prevent a potential collision between the two balls. As ball location is critical to the game of golf, a ball marker is used to temporarily mark the position of the ball. These are commonly small round discs but may be other shapes and configurations. The ball is replaced in position when the danger of collision has passed.

Typically, both pitch repair and ball marker devices are separate accessories, and are carried loosely in the players pocket or in a golf trolley. However, as a pitch repair device can be bulky, it may be somewhat uncomfortable for a player to carry. Moreover, as ball marker devices tend to be small they are easy to misplace. Therefore neither device is typically easily available to a player during a game of golf.

BRIEF SUMMARY OF THE INVENTION

The aim of the present invention is to provide a device which includes pitch repair and/or ball marker functions and is readily available to a player during a game of golf.

In a first aspect of the invention, there is provided an accessory device including a location for the storage of a ball marker member, wherein when located, a portion of said ball marker is available to be gripped and/or rotated against an edge of said location to remove said ball marker from the location.

In one embodiment the device is provided with a pitch repair portion. Typically the pitch repair portion includes one or more legs and/or a finger and thumb support.

In one embodiment the location is a recess and reference hereonin to a recess is for illustrative purposes and should not be interpreted as limiting the scope of the invention.

In one embodiment the bottom edge of the recess is defined by the edge of the pitch repair portion.

Preferably the device is capable of selective attachment to a golf club, said golf club provided with a head portion, a shaft portion and/or a grip, and at least part of said pitch repair portion is capable of being received within location means formed on or attached to the golf club.

In one embodiment location means are provided on the end portion of the golf club grip. In an alternative embodiment, the location means are provided in or on the head portion. In a further embodiment, the device includes retention means to retain at least part of the device inside the golf club grip.

In one embodiment the ball marker is locatable in or on the pitch repair portion and hence located on the golf club grip.

In one embodiment, the retention means are provided by biasing means attached to the legs, such that the legs interengage with the inner wall of the golf club grip or head.

Preferably the retention means includes one or more retention rings or protrusions to interengage with the inner wall of the golf club shaft and/or grip.

Typically the golf club grip includes complementary retention means to that of the device, such as grooves or notches, for interengagement of the same.

Preferably the biasing means are any or any combination of springs, wedges, toggles, and/or the like.

In one embodiment force is applied to a wedge, or a ring connected to closed hinges, to bias the legs to an open position.

In a further embodiment the legs are biased to an open position by springs, and a ring surrounding the legs in a closed position is removed to allow the springs to open the legs.

Preferably the edges of the recess are shaped such that the recess is shallower at one edge than in the center.

Preferably the bottom of the recess is narrower than the top of the recess to improve retention of the ball marker.

Preferably the pitch repair portion is at least partly located in a vertical slot in the golf club grip and the ball marker is located in a vertical recess in the pitch repair portion.

In a further embodiment the ball marker is located in a recess formed in the golf club grip.

Preferably the ball marker is substantially flat and circular, and has a knurled or indented edge.

In one embodiment the ball marker is a sprung washer, such that the force exerted by the spring retains the ball marker in the recess by friction.

Preferably the recess in the golf club grip extends to the edges of the golf club grip.

Therefore when the ball marker is placed in the recess it is substantially hidden from view, with just a small portion protruding. A user can move their thumb or finger over the end of the golf club grip to engage the ball marker, rolling it towards an edge of the golf club grip. As the recess gets shallower towards the edge of the golf club grip, more of the ball marker is exposed, allowing a user to remove the ball marker from the recess. In one embodiment the recess is formed in an article which is in turn located in the grip.

Preferably the ball marker is manufactured from a ferrous material so that it is attractable to a magnet.

Preferably the ball marker is retained by retention means including any or any combination of end stops, sprung grips, magnets, profiled steps, friction, and/or raised portions of the cap and/or ball marker and or golf club grip, either directly in the golf club grip or in the pitch repair portion hence forming a combined device.

The ball marker may have a central aperture to engage with raised portions of the golf club grip and aid retention.

In one embodiment the raised strips or profiled steps are low enough to allow the ball marker to be removed by sliding over the same, and high enough to prevent accidental release of the ball marker.

The ball marker can easily be removed by the user sliding a thumb across the top of the same and contacting and rotating the ball marker out of the recess. This horizontal movement is very user-friendly.

In one embodiment, the device includes extraction tabs, which are flush or recessed with respect to the outer perimeter of the golf club grip and flush with the top of the same.

The extraction tabs facilitate removal of the device from the grip, and as they are recessed they do not interfere or get caught on other clubs or objects thereby preventing accidental removal of the device. By squeezing the finger and thumb across the tabs the user's skin will fill or flow into the recess and achieve sufficient grip around the tabs for easy removal of the unit.

In one embodiment the extraction tabs connect to a locking mechanism, locking the device to the golf club grip, such that squeezing the extraction tabs releases the locking mechanism, allowing removal of the device from the golf club shaft and/or grip.

Typically the retention means form at least part of the locking mechanism.

Typically the locking mechanism is biased towards a locked state by the force provided by legs under tension.

Movement of the legs connected to the extraction tabs and providing this force may also cause movement of legs providing a retention force directly to the golf club grip or shaft.

In one embodiment at least part of the locking mechanism is formed from an extension of the legs under tension.

In a further embodiment the ball marker retention means forms at least part of the locking mechanism.

In a further embodiment, the golf club grip or pitch repair portion includes an ejector mechanism to eject the ball marker from the recess.

Preferably the ejector mechanism includes any or any combination of buttons, springs, knobs, magnets, and/or the like.

In an alternative embodiment the ball marker is located in a recess in the head of the golf club, and retained as herebefore described.

In one embodiment the legs and/or finger and thumb support and/or engagement tabs interengage with holes and/or slots in the top of the golf club grip.

In another embodiment, the hole is split, such that it is widened by insertion of a part of the device, thereby providing a frictional force on the same.

Typically the upper end of the putter shaft is oval to maximise the space provided for the pitch repair portion.

In one embodiment, the legs and/or finger and thumb support are moveable between an open position and a closed position. Alternatively, the legs and/or finger and thumbs support are fixed.

Preferably the legs and/or finger and thumb support are hingeably attached at the ends of the legs and/or finger and thumb support. Alternatively the legs and/or finger and thumb support are hingeably attached around their centres so they are moveable with a scissor action. Further alternatively the legs and/or finger and thumb support are hingeably attached on their edges so that the legs and/or finger and thumb support can be superposed.

In a further embodiment, the legs are hingeably connected to the device, allowing the legs to collapse and fold up towards the golf club grip opening.

The legs thereby improve retention as they interfere with the inner surface of the golf club shaft and/or grip.

In one embodiment the legs can be folded to prevent interference with the inner surface of the golf club grip by actuation of the extraction tabs.

Typically the legs are profiled to prevent overload during pitch repair.

In a further embodiment, the legs are pivotally mounted on the finger and thumb support.

Typically the device includes means to control the final opening position of the legs.

Typically the device includes biasing means to provide frictional force between the device and the inner wall of the golf club grip or shaft.

In a further embodiment, finger supports are provided on the legs to aid compression of the same to allow the device to be inserted into the golf club grip or shaft.

In an alternative embodiment, the legs are twisted such that the free ends are substantially perpendicular to the other ends. This allows the free ends to overlap with a scissor action, and provide finger support where the sections of the legs are in a flattened configuration.

The legs can be thicker in the load-bearing direction without significantly affecting the compression characteristics.

Typically the pitch repair portion can include any or any combination of bottle opener; leg locking peg and retention hole; wire stripper; knife blades on scissor action legs; screwdriver; nail or groove cleaner for the club face; serrated blade; nail file; boot stud removal tool, and prising tool.

In a second aspect of the invention, there is provided a grip for attachment to a golf club shaft, said grip including location means for a golf accessory device, said golf accessory device including a portion capable of receiving a ball marker, wherein the device includes retention means which engage with the grip and/or golf club shaft.

In a third aspect of the invention, there is provided a golf accessory device having a cap, a body, and at least one leg acting as a pitch repair portion depending therefrom, wherein the cap includes a recess for receiving and/or selectively locating a ball marker member when the ball marker member is not in use.

Typically the ball marker member can be slid out from the recess for use by the user.

In a fourth aspect of the invention, there is provided a golf accessory device including a recess for at least partially receiving a ball marker member, a portion of said ball marker protruding from said recess when not in use, to enable a user to grip the portion and remove the ball marker member from said recess.

BRIEF DESCRIPTION OF THE DRAWINGS

Specific embodiments of the invention are now described wherein.

BRIEF DESCRIPTION OF THE PREFERRED EMBODIMENTS

Figure 1:
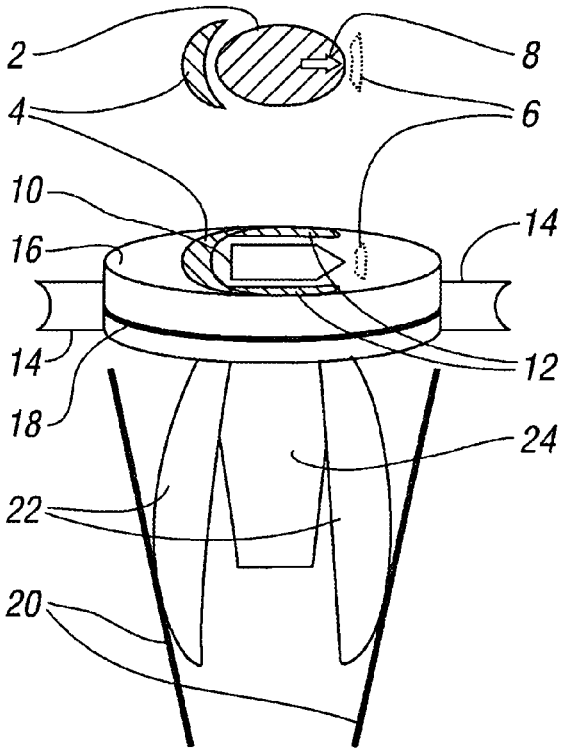
FIG. 1 illustrates a schematic view of a ball marker and pitch repair device fitting into a golf club grip and shaft.
Figure 3A:
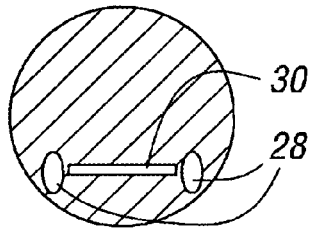
FIGS. 3*a-d* illustrate further schematic views of the pitch repair portion; (a) in relation to a golf club grip from above; (b) in relation to a golf club grip from the back; (c) from the front; (d) from the side.
Figure 3B:
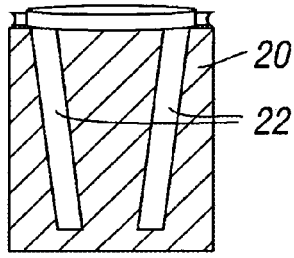

With reference to FIG. 1, there is illustrated a ball marker 2 located in recess 10 and retained by end stop 4, grips 12 and raised strip 6. The recess 10 is located on the cap 16 of the device. The ball marker 2 can be removed by sliding over the raised strip 6 in the indicated direction 8. The raised strip 6 or dimple helps prevent accidental release of the ball marker 2, for example during transport in a golf bag. When inserting the ball marker 2, it is guided in to the recessed face and retained by the grips 12 on either side of the recess 10, allowing a compression fit of the ball marker 2 against the slot.

The pitch repair portion of the device includes a finger and thumb support 24 and one or more collapsible legs 22. The legs 22 are sprung with an outward force i.e. the tips are biased away from each other. The pitch repair portion fits inside the grip and shaft 20 of the golf club, such that the tips of the legs 22 grip the inside of the golf club grip 20 by friction caused by the outwards bias. As the golf club grip 20 becomes narrower, the frictional grip increases, thereby improving retention of the device.

The cap 16 includes extraction tabs 14, which are recessed with respect to the outer perimeter of the golf club grip 20 and flush with the top of the same. The cap 16 also includes a retention ring 18, which helps retain the device in the golf club grip 20 by engaging with a complementary groove (not shown) in the golf club grip 20.

Figure 2:
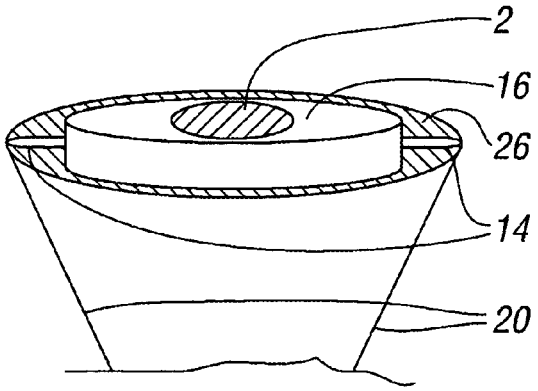
FIG. 2 illustrates an external view of a ball marker and pitch repair device fitted into a golf club grip.
Figures 3C, 3D:
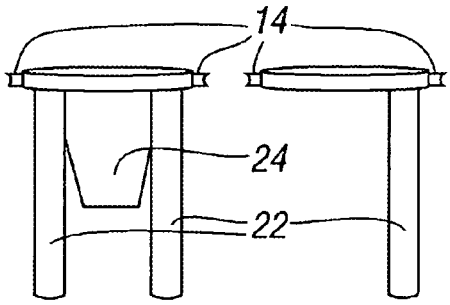

Referring to FIG. 2, when the device is fully inserted into the golf club grip 20, the upper portion of the cap 16 (above the retention ring) is proud of the top 26 of the golf club grip 20, aiding easy removal and return of the ball marker 2. The extraction tabs 14 are flush with the top 26 of the golf club grip 20.

Referring to FIGS. 3*a-d*, the golf club grip 20 is shown in more detail from above, and the holes 28 in which the legs 22 fit are asymmetrically positioned on the golf club grip 20 such that the legs 22 engage the golf club grip 20 but not necessarily the golf club shaft. The slot 30 is sized for insertion of the finger and thumb support 24 and/or legs 22. The recessed extraction tabs 14 are essential for easy extraction of the device from the golf club grip 20.

Figure 4A:
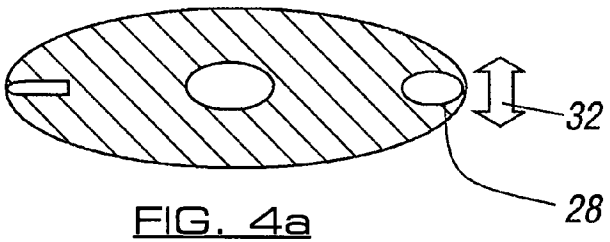
FIG. 4 illustrates a schematic view of the golf club grip gripping the pitch repair portion; (a) from above; (b) from the side.
Figure 4B:
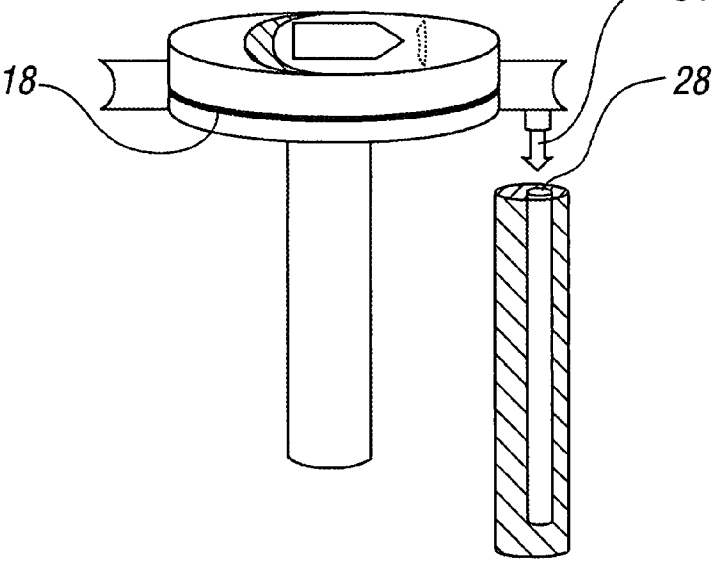

Referring to FIGS. 4*a-b*, the hole 28 is split along the outside edge of the golf club grip, such that as the legs or extraction tabs are pushed in as indicated by arrow 34, the split is widened as indicated by arrow 32, thereby providing a frictional force on the same, the fit tightening as the device is inserted further into the golf club grip. Retention could therefore be achieved without the need for retention ring 18, or compression or other movement of the legs.

Figure 5:
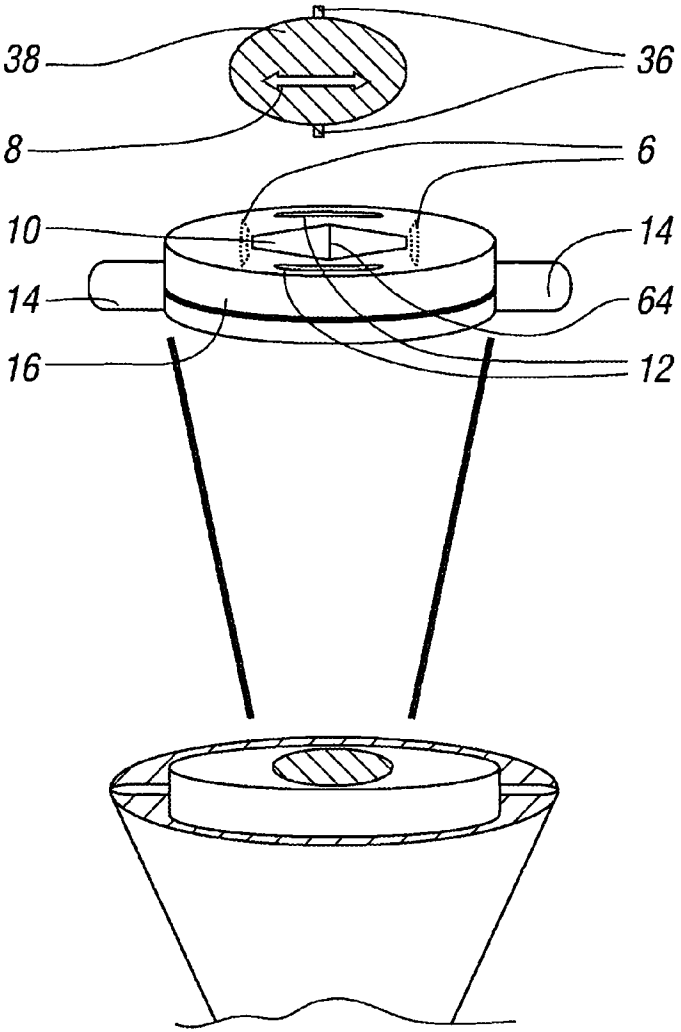
FIG. 5 illustrates a schematic view of a second embodiment of a ball marker portion in relation to a golf club grip.

Referring to FIG. 5, an alternative ball marker 38 is indicated, with positional wing stops 36 which engage with groove 64 and aid retention in recess 10 which is sloped down towards the groove 64. The ball marker 38 is retained by grips 12, and raised dimples 6 help prevent accidental release of the ball marker 2. The ball marker 2 can be removed in either direction as indicated by arrow 8 by sliding over the raised strip 6.

Figure 6A:
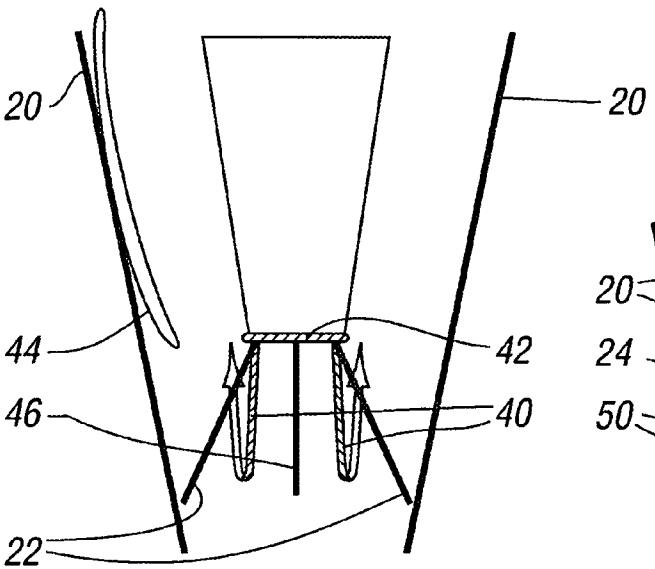
FIG. 6 illustrates a schematic view of a second embodiment of (a); a pitch repair portion in relation to a golf club grip; (b) a profiled leg of a pitch repair portion.

Referring to FIG. 6*a*, a modified pitch repair portion is indicated including a hinge 42 that allows the legs to collapse and fold up toward the golf club grip opening, as indicated by arrow 40, into a position as indicated by leg 22. This interference fit improves retention. Where the pitch repair portion enters the golf club grip in an asymmetric position (as shown for example by FIG. 3*a*) the legs 22 are bent towards the central axis of the golf club grip and shaft cavity. The device is stored with legs under lateral load after use i.e. the load in storage is in a different direction to the direction of the load when using the device to repair a pitch. Leg 46 is the strongest leg and is attached to the device at a different angle to that of the other legs 22 such that in use it enters the ground at a steeper angle.

Figure 6B:
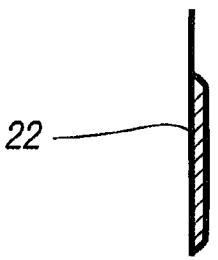

Referring to FIG. 6*b*, profiled legs prevent overload during pitch repair, allowing the legs to cut or slice through into the ground.

Figure 7:
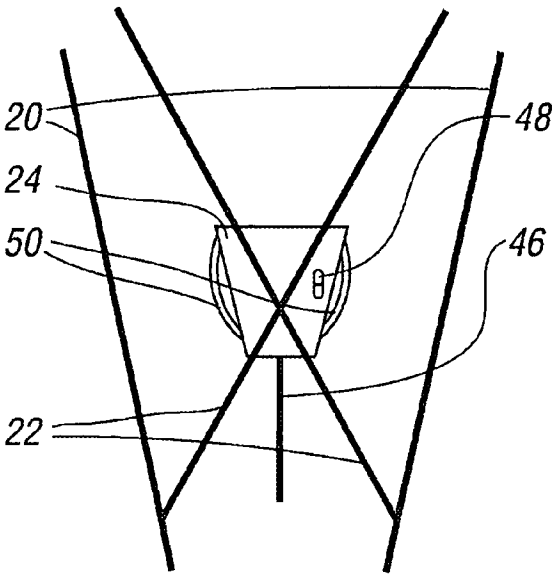
FIG. 7 illustrates a schematic view of a third embodiment of a pitch repair portion in relation to a golf club grip.

Referring to FIG. 7, the legs 22 are pivotally mounted on finger and thumb support 24, and the legs collapse as they are pushed down the internal wall of the golf club grip 20. The final opening position of the legs 22 is controlled by peg 48. The finger and thumb support 24 is configured to be in an intuitive position for use in pitch repair. The finger and thumb support 24 also includes leaf springs 50 which increase the surface retention force as they are forced against the inner wall of the golf club shaft or grip 20.

Figure 8A:
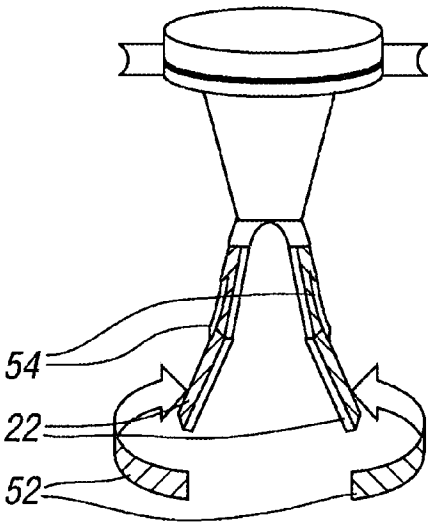
FIG. 8 illustrates a schematic view of a fourth embodiment of (a) a pitch repair portion in relation to (b) a golf club grip.
Figure 8B:
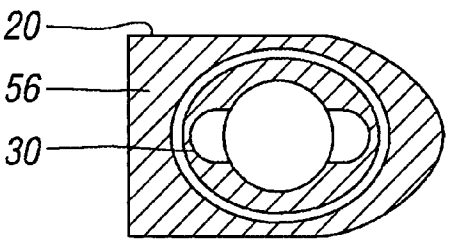

With reference to FIGS. 8*a-b*, a modified pitch repair portion is indicated with a complementary golf club grip 20. The pitch repair portion includes finger supports 54 on the legs 22, which are more comfortable than the edges of the legs 22 and/or aids the user in compressing the legs 22 into the golf club grip. The golf club grip 20 has an enlarged slot 30 shaped to receive the pitch repair portion, which descends into the putter shaft 56.

Figure 9A:
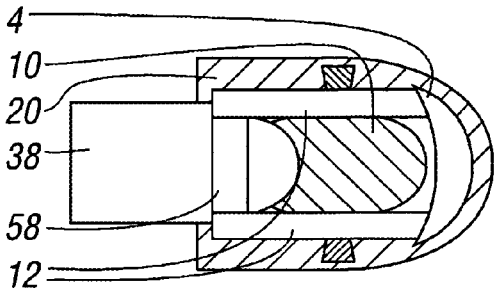
FIG. 9 illustrates a schematic view of a third embodiment of a ball marker portion (a) from above; (b) from the ball marker replacement angle; (c) in relation to the cap of the device.
Figure 9B:
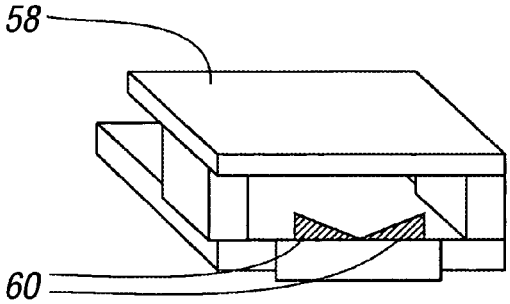
Figure 9C:
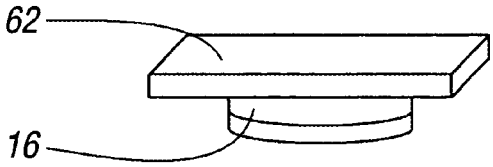

With reference to FIGS. 9*a-c*, a further embodiment of a ball marker portion is indicated in relation to a golf club grip 20.

The ball marker 38 is passed through an opening as defined by section 58 through to an area where it is retained as hereinbefore described. Profiled steps 60 adjacent to section 58 allow the ball marker 38 to be 'snapped-in', and helps prevent accidental release of the same.

The cap 16 is not limited by the size of the ball marker 38, and for example the retaining plug in the golf club grip can be smaller than the ball marker holder 62 as indicated.

Figure 10:
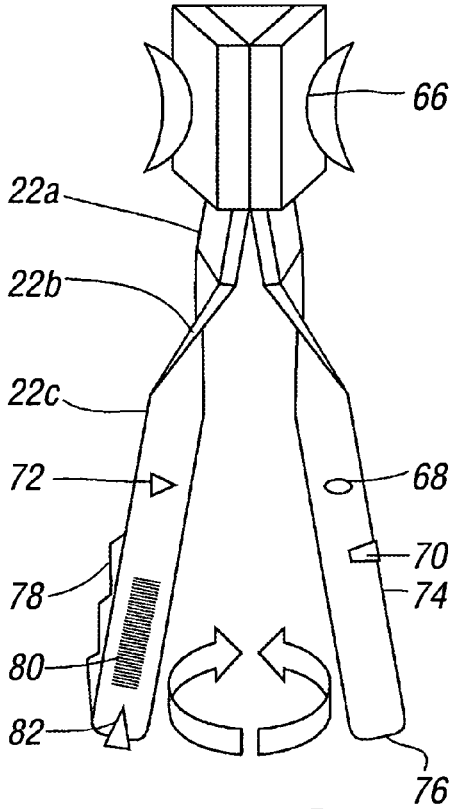
FIG. 10 illustrates a schematic view of a fifth embodiment of the pitch repair portion.

Referring to FIG. 10, the legs are shown in greater detail, with a thicker portion 22*a* which are thicker in the load bearing direction without significantly affecting the leg compression characteristics; a pre-twisted section 22*b* to enable a scissor action when the legs are compressed with finger and thumb; and a flat section 22*c* which removes the requirement for a finger support as the flat face of the leg rests on the finger, the thumb resting naturally on and between the pre-twisted sections 22*b*. The twist of the pre-twisted sections 22*b* causes the flat sections 22*c* to be substantially perpendicular to the thicker portions 22*a*, such that the flat sections 22*c* can overlap when the legs are compressed.

Other enhancements are also indicated;

A bottle opener 66;

A locking peg 72 and corresponding retention hole 68 for holding the legs together;

A wire stripper 70;

Knife blades 74 to perform that cut in a scissor action;

A screwdriver 76, nail or groove cleaner for the club face;

A serrated blade 78 on the side of the leg;

A nail file 80;

A small prising tool 82.

Figure 11A:
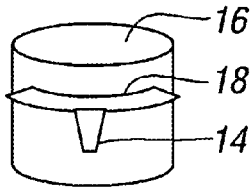
FIG. 11 illustrates further detail of the retention ring for retention of the device in the golf club grip (a) from the side (b) from above in relation to the legs below.
Figure 11B:
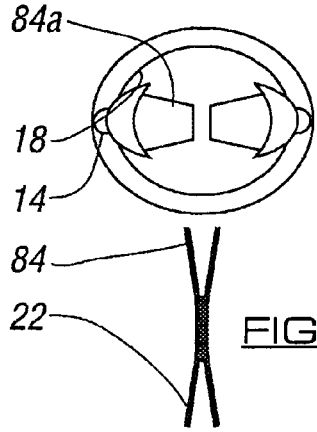

Referring to FIG. 11, the cap 16 is indicated with a spring-loaded retention ring 18 for locking the device into a golf club grip or shaft. The retention ring 18 retracts when the recessed tabs 14 are squeezed between finger and thumb, allowing the device to be removed. The spring force provided to the retention ring is generated by the upper section 84*a* of legs 84 which are under tension and thereby force the recessed tabs 14 in an outwardly direction relative to the golf club grip or shaft. The legs 84 may act independently of legs 22, or can be connected such that movement of legs 84 caused by pressure on recessed tabs 14 leads to movement of legs 22 and removal of the retention force generated by the same against the golf club grip or shaft.

Figure 12A:
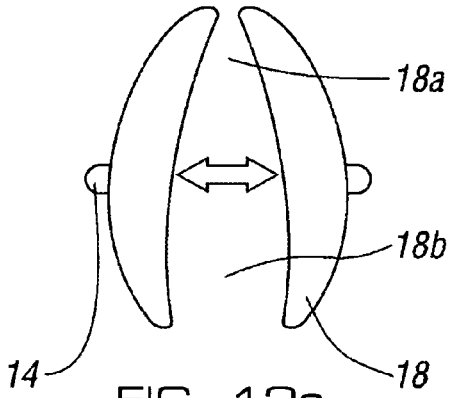
FIG. 12 illustrates a further example of the retention ring for retention of the ball marker (a) from above (b) from the side.
Figure 12B:
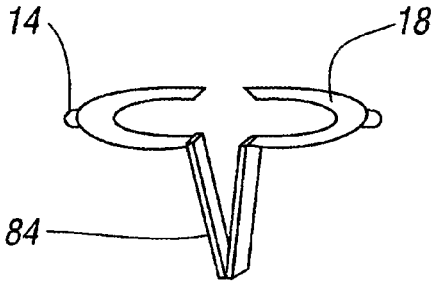

Referring to FIG. 12, the retention ring 18 interengages with the golf club grip or shaft and/or retains a ball marker. The retention ring 18 has at least one opening 18*b* through which a ball marker may pass, and narrows or is pinched on the opposite side 18*a* of the retention ring 18 thereby providing an end stop for the ball marker. The retention ring 18 may be a folded extension of legs 84, which are under tension as hereinbefore described.

Figure 13A:
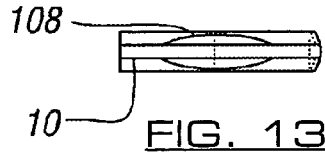
FIG. 13 illustrates a schematic view of a further embodiment of a ball marker and pitch repair device (a) from above; (b) from the side; (c) from the front.
Figure 13B:
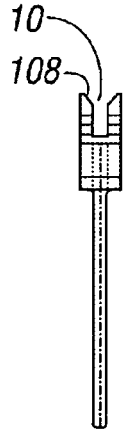
Figure 13C:
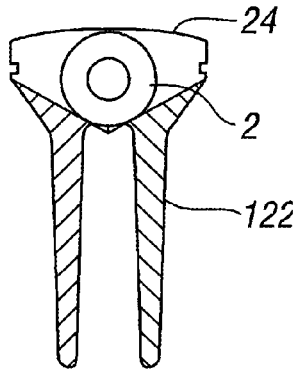

With reference to FIG. 13, there is illustrated a pitch repair device including legs 122 and a finger/thumb support 24. The pitch repair device includes a recess 10 into which a ball marker 2 can be fitted. The recess may have angled upper edges 108 to facilitate access to the ball marker 2. The ball marker 2 is therefore substantially enclosed by the recess 10 except for a small portion which is exposed in the region of the angles upper edges 108. A user can access the ball marker 2 at this point, and roll the ball marker 2 towards an edge of the recess 10. As the bottom edges of the recess 10 are angled such that towards the edges the recess 10 is shallower, the ball marker 2 is raised out of the recess 10 as it approaches the edge of the same, thereby allowing the user the remove the ball marker 2 from the recess 10. Alternatively the indents formed by the angled upper edges 108 allow a user to simply grip the ball marker 2 by the edge and pull it out.

Figure 14A:
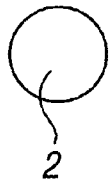
FIG. 14 illustrates a schematic view of a ball marker (a) from the front; (b) from the side.
Figure 14B:
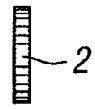

FIG. 14 shows a ball marker 2 in more detail, with straight knurled edges to assist a user in gripping the same. The ball marker in this example is round so that it rolls easily out of the pitch repair device.

Figure 15A:
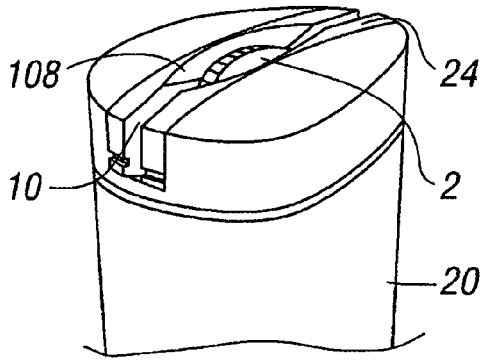
FIG. 15 illustrates a perspective view of a pitch repair device and ball marker as indicated by FIG. 13 in a golf club grip.
Figure 16A:
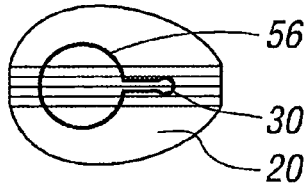
FIG. 16 illustrates the interaction between a pitch repair device and a golf club grip as indicated by FIG. 15 (a) outline viewed from above; (b) outline viewed from the front; (c) cutaway from the side; (d) schematically from the front.
Figure 16B:
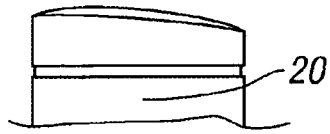
Figure 15B:
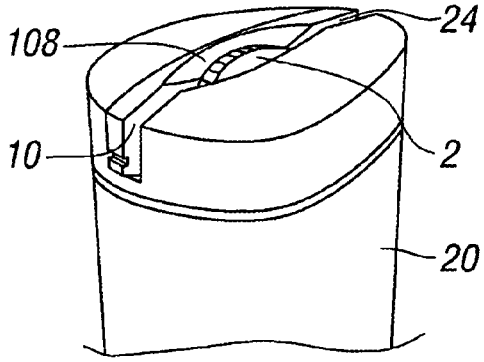
Figure 16C:
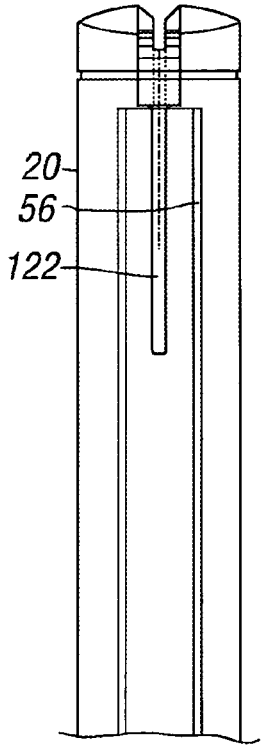
Figure 16D:
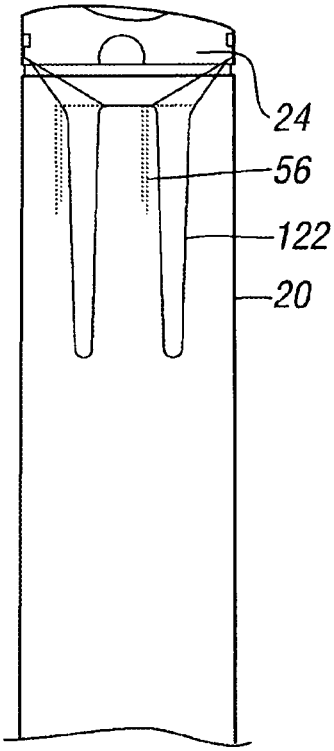

Referring to FIG. 15, there is shown a ball marker 2 and a pitch repair device fitted to a golf club grip 20. FIG. 15*a* displays a recess 10 wherein both walls of the recess 10 are formed by the pitch repair device. FIG. 15*b* displays a recess 10 wherein one wall is formed by the pitch repair device and the other is formed by the golf club grip 20. As golf club grips are typically manufactured from rubber or a derivative therefrom, this may help to increase the retention force on the ball marker 2.

With reference to FIG. 16, the golf club is indicated with a grip 20 and shaft 56. One of the legs 122 of the pitch repair device fits into the shaft 56. The other fits into a hole 30 in the grip 20, with the split connecting the hole and the shaft to allow movement of the hole 30 as the leg is inserted. The hole diameter may be slightly smaller than that of the leg so that the leg 122 is subject to frictional forces from the edges of the hole 30. The hole 30 is split so that it opens inside the grip 20 rather than outside the grip 30, to prevent mechanical damage to the same.

Figure 17:
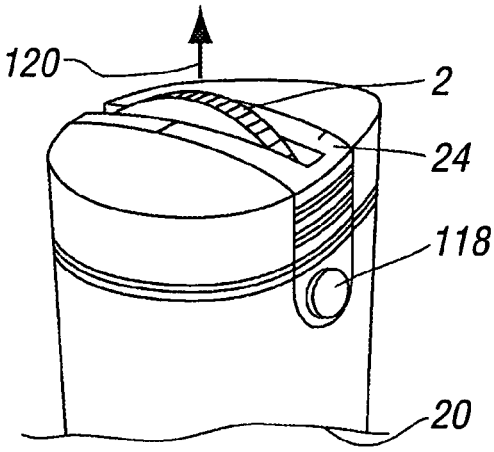
FIG. 17 shows a further embodiment of the pitch repair device which includes a ball marker ejection section.

Referring to FIG. 17, the pitch repair device includes a button 118 for releasing the ejection mechanism and ejecting the ball marker in the indicated direction 120. The ejection mechanism may include springs, magnets, levers and the like, and is locked on insertion of the ball marker.

Figure 18A:
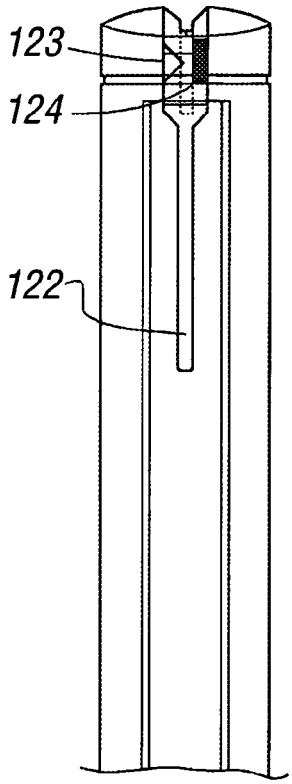
FIG. 18 illustrates a yet further embodiment of a device in accordance with the invention (a) cutaway from the side; (b) schematically from the front; (c) in a perspective view; (d) in an alternative form in perspective; (e) in an alternative form from the side; (f) in an alternative form in use.
Figure 18B:
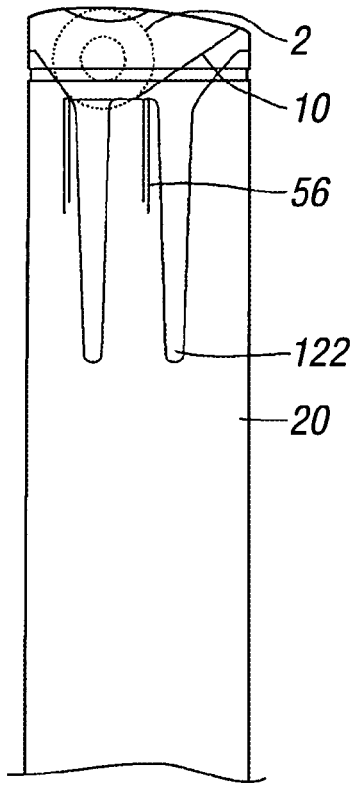
Figure 18C:
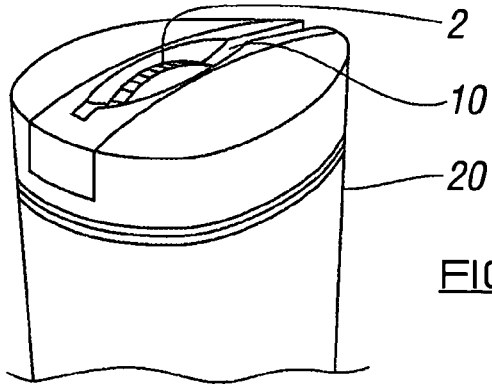

Referring to FIGS. 18*a-c*, the device includes a recess 10 with a sloping bottom edge which allows a ball marker 2 to be rolled in and out of the recess 10 from one side of the grip 20. Further retention means for the ball marker 2 are indicated, including a protrusion 123 of the grip 20 and a magnet 124. These features act on and improve the retention of the ball marker 2 in the recess 10.

Figure 18D:
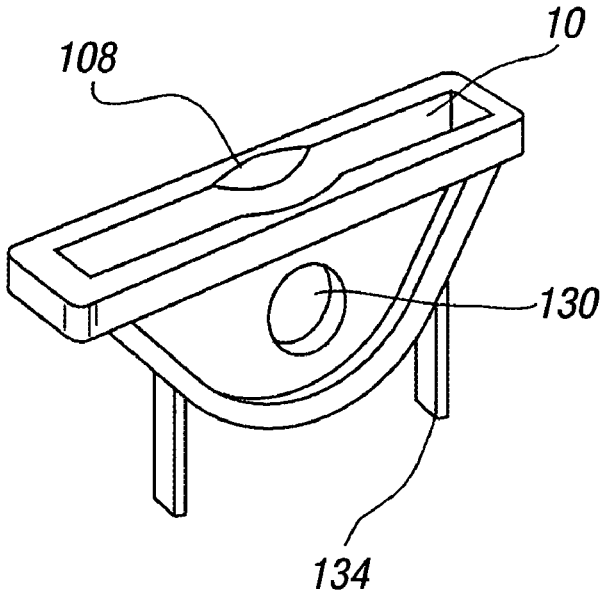
Figure 18E:
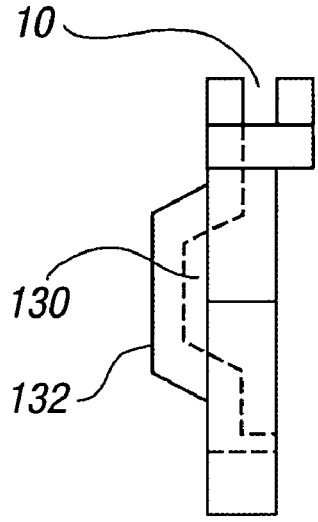

Referring to FIGS. 18*d-e* the device includes a recess 10, where one side of the recess is bounded by the device, the other by a golf club grip, such that a ball marker can be located in the recess and rotated against the sloping bottom edge to roll out from the recess 10. The device is extruded to form an alcove 130 for a magnet or other ball retention means to be placed therein. The extrusion causes a protrusion 132 to be formed on the reverse side of the device, which enables the device to be locked into place in a golf club grip, matching a complimentary recess in the golf club grip. Additional protrusions 134 are provided to prevent the device from twisting when placed in the golf club grip.

Figure 18F:
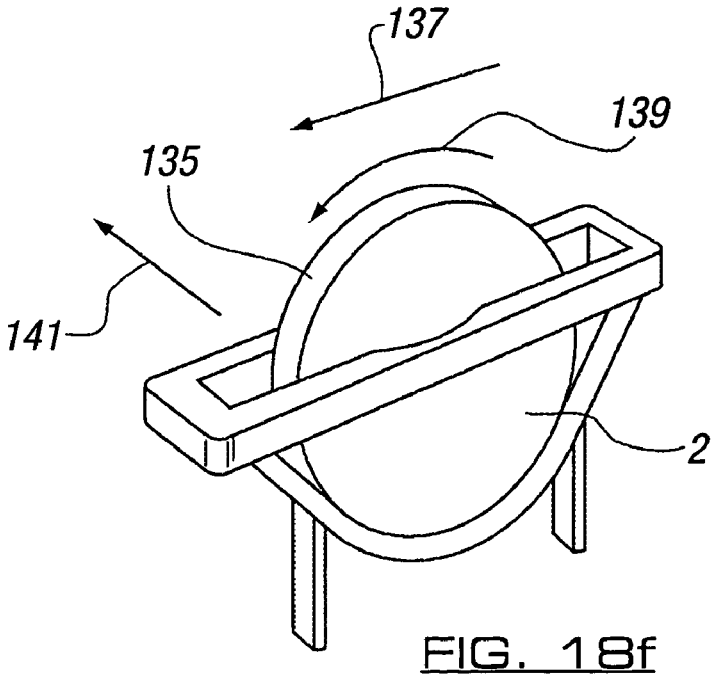
Figure 19A:
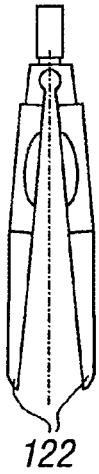
FIG. 19 illustrates a pitch repair device with alternative collapsible leg configurations (a) sprung; (b) wedge; (c) toggle; (d) folding.
Figure 19B:
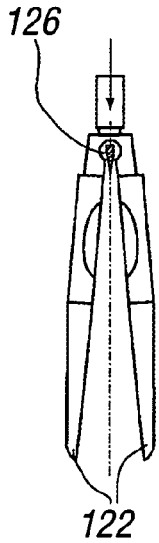

The ability to rotate the ball marker out of the recess by contact with the person's finger with the edge 135 of the protruding portion of the ball marker, as shown in FIG. 18*f*, allows the movement of the finger in the direction 137 to rotate the ball marker 2 against the recess edge and hence cause the marker to rotate as indicated by arrow 139, and move out of the recess in the direction of arrow 141. Of course, as an alternative, a portion of the ball marker can be gripped and lifted out of the recess, but this will require two fingers to be used and in many instances is not as convenient. Thus the ability to rotate the ball marker and the provision of the recess slope which acts as a guide to the rotating ball marker provides a particularly effective way of removing the ball marker.

With reference to FIG. 19, the legs 122 may have several configurations to assist in retaining the device in the grip. FIG. 19*a* illustrates the legs 122 in a sprung configuration, wherein the legs 122 are biased outwardly to increase friction on the inner wall of the golf club grip. FIG. 19*b* illustrates the legs 122 with a wedge 126, wherein when the wedge 126 is pushed down in the direction indicated, the legs 122 are forced apart. FIG. 19*c* illustrates the legs 122 with a toggle 128, which when pushed down forces the legs 122 apart and/or when pulled up brings the legs 122 together.

Figure 19C:
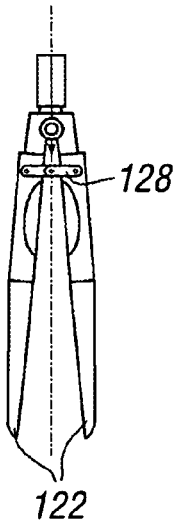
Figure 19D:
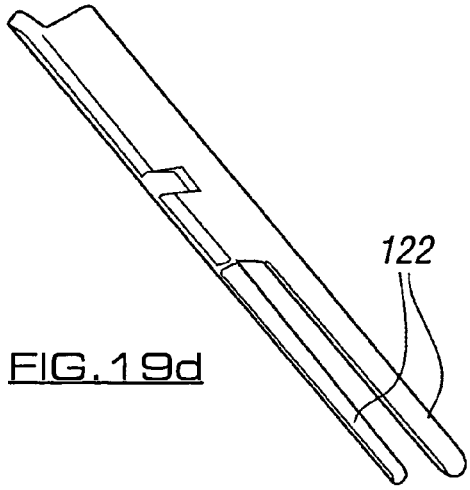
Figure 21A:
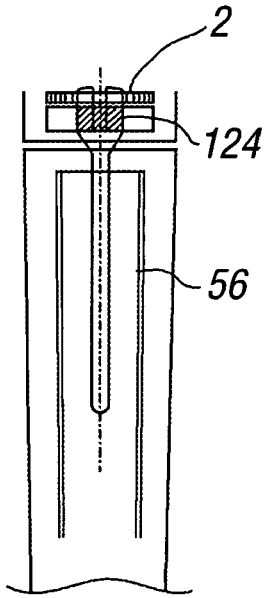
FIG. 21 illustrates a horizontally mounted ball marker with a fixed leg pitch repair portion (a) cutaway view from the side; (b) cutaway view from the front; (c) cutaway view from above; (d) perspective view.
Figure 21B:
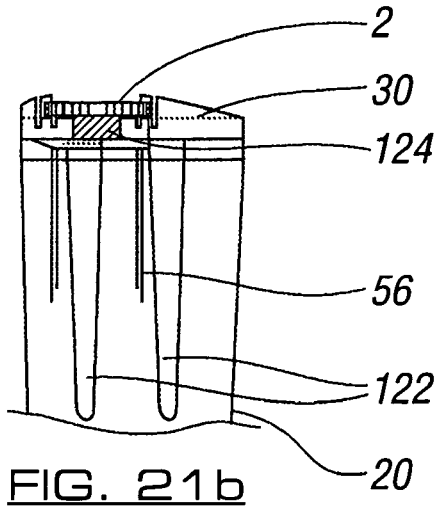
Figure 21C:
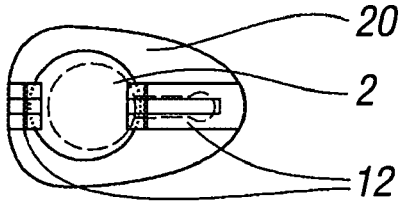

FIG. 19*d* illustrates a perspective view of a pitch repair device which can be folded lengthwise such that the legs 122 are superposed. This reduces the width of the device so that both legs 122 can be inserted into the golf club shaft.

Figure 20A:
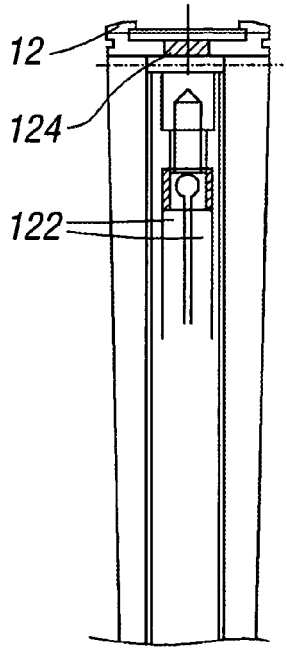
FIG. 20 illustrates a further embodiment of the device wherein the ball marker is mounted horizontally on the pitch repair device or golf club grip, as (a) cutaway view from the side; (b) schematically from the front; (c) perspective view.
Figure 20B:
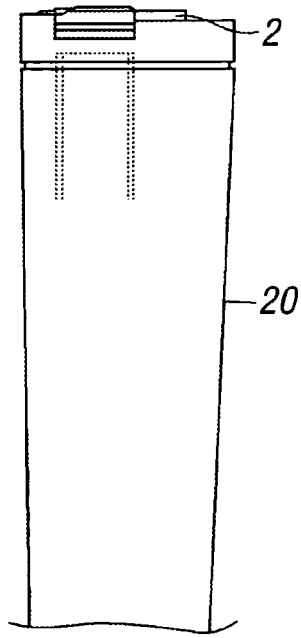
Figure 20C:
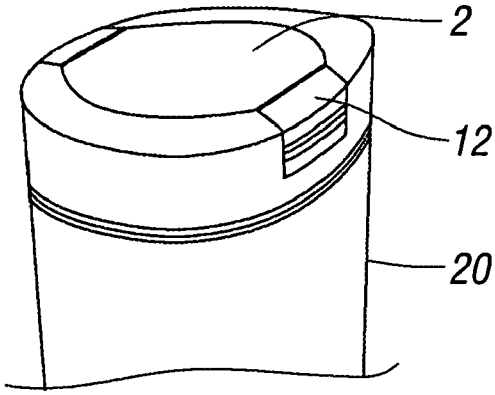
Figure 21D:
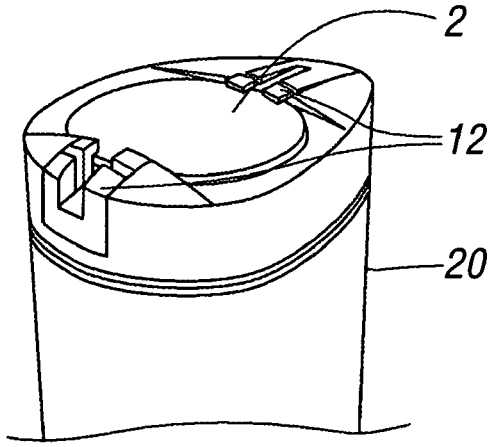

Referring to FIG. 20, the ball marker 2 is illustrated in a horizontal configuration with respect to the collapsible legs 122 of the pitch repair portion, rather than vertical as indicated in previous figures. The ball marker 2 is held in place by raised grips 12 and/or a magnet 124 situated underneath the ball marker 2. In use, the ball marker 2 is slid out horizontally from the grips 12 and replaced in a similar manner.

Referring to FIG. 21, there is illustrated a pitch repair device with fixed legs 122, and a horizontally sliding ball marker 2 positioned on top of the pitch repair device and held in place by grips 12 and or magnets 124. The grip 20 may also overlap the ball marker 2 to improve retention of the ball marker 2, the grip being pushed aside when a user slides the ball marker 2 from the grip 20. The legs 122 of the pitch repair device slot into the shaft 56 of the golf club and a hole or slot in the golf club grip 20, such that the pitch repair device is secured to the golf club grip 20 by friction.

It will be appreciated that the pitch repair portion and/or ball marker as hereinbefore described may also be attached in a similar fashion to the head of the golf club rather than the golf club grip, adapted accordingly to provide reception means thereon or therein.

It will be appreciated by persons skilled in the art that the present invention also includes further additional modifications made to the device which does not effect the overall functioning of the device.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

The invention claimed is:

1. An accessory device, said device comprising:

a substantially flat ball marker;

a recess, for location of the ball marker, being formed in the device and having one side bounded by the device and having a sloping bottom edge;

ball marker retention means formed in the device;

a first protrusion formed in one side of the device for locking into a golf club grip;

additional protrusions being provided to prevent twisting of the device when placed into the golf grip; and wherein said ball marker is removed from said recess by rotating an edge of said ball marker against said recess sloping bottom edge.

2. An accessory device according to claim 1 wherein said retention means includes a magnet.

3. An accessory device according to claim 1 wherein said ball marker can be rolled out of the device by a user.

4. A golf club grip, said golf club grip comprising:

a recess therein for receiving an item for use as a ball marker;

said item is provided with at least one substantially planar face; wherein said planar face is disposed substantially parallel to the longitudinal axis of the grip when in the recess and engages with an internal portion of the golf club grip and retention means are provided to retain said item in said recess wherein said retention means includes a magnet.

5. A golf club grip according to claim 4 wherein said planar face is engaged by raised portions of said golf club grip.

6. A golf club according to claim 4 wherein said planar face is substantially hidden from view when said item is disposed in said recess.

* * * * *